US007956707B2

(12) United States Patent
Engst

(10) Patent No.: US 7,956,707 B2
(45) Date of Patent: Jun. 7, 2011

(54) ANGLED METALLIC RIDGE FOR COUPLING COMBLINE AND CERAMIC RESONATORS

(75) Inventor: Bill Engst, Marlboro, NJ (US)

(73) Assignee: Radio Frequency Systems, Inc., Meriden, CT (US)

( * ) Notice: Subject to any disclaimer, the term of this patent is extended or adjusted under 35 U.S.C. 154(b) by 200 days.

(21) Appl. No.: 12/255,413

(22) Filed: Oct. 21, 2008

(65) Prior Publication Data

US 2010/0097162 A1 Apr. 22, 2010

(51) Int. Cl.
*H01P 1/20* (2006.01)
*H01P 1/205* (2006.01)

(52) U.S. Cl. ..... 333/202; 333/203; 333/219.1

(58) Field of Classification Search ..... 333/202, 333/203, 219.1, 222
See application file for complete search history.

(56) References Cited

U.S. PATENT DOCUMENTS 2,808,522 A 10/1957 Dranetz
3,060,748 A 10/1962 Schwartz
3,120,622 A 2/1964 Dranetz et al.
3,186,237 A 6/1965 Forrest
4,477,785 A * 10/1984 Atia ..... 333/202
5,969,584 A * 10/1999 Huang et al. ..... 333/202
6,081,175 A 6/2000 Duong et al.
6,573,812 B1 * 6/2003 Wakamatsu et al. ..... 333/219.1
6,614,327 B2 * 9/2003 Saito et al. ..... 333/202

OTHER PUBLICATIONS

Bhargava, A., Time & Frequency, Combline Filter Design Simplified, Jan. 2004, pp. 42, 44, 46 and 48, www.rfdesign.com.

* cited by examiner

*Primary Examiner* — Benny Lee
(74) *Attorney, Agent, or Firm* — Kramer & Amado P.C.

(57) ABSTRACT

An apparatus for coupling a combline resonator and a ceramic resonator, including one or more of the following: a housing; a combline resonator in the housing; a ceramic resonator in the housing, the ceramic resonator having a stem portion and a mushroom portion; a ridge extending between the combline resonator and the ceramic resonator, the ridge passing between the mushroom portion of the ceramic resonator and the housing, wherein a coupling is obtained between an electrical field of the combline resonator and an electrical field of the ceramic resonator.

15 Claims, 1 Drawing Sheet

ANGLED METALLIC RIDGE FOR COUPLING COMBLINE AND CERAMIC RESONATORS

BACKGROUND OF THE INVENTION

1. Field of the Invention

This invention relates generally to coupling between combline and ceramic resonators.

2. Description of Related Art

Cavity resonators are electronic components that produce oscillations at a specified frequency. Cavity resonators can be fashioned so that only certain combinations of electric and magnetic fields exist within the cavity. Such cavities are useful because they can filter out electromagnetic field energy that occurs at undesired frequencies.

A resonant cavity can be structured so that only particular modes of an electromagnetic field are utilized within the cavity. A dielectric post may be placed within the cavity, with its longitudinal axis extending out from a sidewall of the cavity, so as to be substantially perpendicular to the direction of flow of electromagnetic field energy within the cavity. Such posts impose boundary conditions on the electric and magnetic fields, in addition to the behavior imposed by the electrically conducting metallic material of the cavity resonator's walls.

For a ceramic resonator, the term dielectric post is used here to mean a non-metallic puck, a short cylinder of ceramic material, held away from a wall of the cavity by a support. The longitudinal axis of the dielectric puck is substantially perpendicular to the direction of flow of electromagnetic field energy within the cavity resonator. The puck may be shaped as a disk, having a circular cross-section, but could also be designed to have other shapes.

Because the post material is ceramic, the cavity can resonate in a transverse electric (TE) mode, in particular the $TE_{011}$ mode. In such a mode, in a cavity resonator with a ceramic puck, the electric field will be purely azimuthal with respect to the central axis of the ceramic puck and largest within the ceramic puck. Because the walls of the cavity resonator are metallic, the electric field will decrease in intensity away from the ceramic puck, vanishing at the walls of the cavity. On the other hand, the magnetic field will be orthogonal to the electric field and will have no azimuthal component anywhere in the cavity resonator.

As is evident from the above description of the electric and magnetic fields, if a ceramic cavity is physically adjacent to a metallic cavity, and no special structure is used to couple the two cavities, then the axis of the ceramic puck in the ceramic cavity must be perpendicular to the axis of the metallic cavity. It also must be perpendicular to the direction of flow of energy so that either the magnetic fields or the electric fields in the two cavities align. If this is not done, there can be no flow of energy between the cavities because the magnetic and electric fields in the second cavity can only exist in an orientation not possible for the corresponding fields in the first cavity.

There are several known ways to couple dissimilar cavities, such as metallic combline and ceramic resonators. One approach involves mechanical orientation of physically adjacent cavities, but this technique fixes the layout of the cavities, resulting in complex structures if multiple cavities are used. Another coupling technique uses either a probe-to-probe structure to draw the electric field from one cavity into an orientation suitable for the physically adjacent cavity, or a loop-to-loop structure to perform a similar alignment operation on the magnetic field. A probe-to-loop structure would allow the electric field in one cavity to induce a magnetic field in the physically adjacent cavity. However, these probe and loop structures have the drawback that they may be used only for relatively narrow bandwidth filters because the electric coupling they provide is relatively weak.

U.S. Pat. No. 6,081,175 to Duong et al. discloses a coupling structure for coupling cavity resonators. However, the coupling between dissimilar resonators disclosed by this reference cannot be easily controlled. Accordingly, what is needed is a structure that controllably couples dissimilar resonators, such as ceramic and metallic combline resonators, without fixing the relative orientations of the dissimilar resonators.

SUMMARY OF THE INVENTION

In light of the present need for coupling between metallic combline and ceramic resonators, a brief summary of various exemplary embodiments is presented. Some simplifications and omissions may be made in the following summary, which is intended to highlight and introduce some aspects of the various exemplary embodiments, but not to limit the scope of the invention. Further detailed descriptions of preferred exemplary embodiments, adequate to allow those of ordinary skill in the art to make and use the inventive concepts will follow in later sections.

The present invention is a structure that couples physically adjacent cavity resonators where the electric and magnetic fields in one cavity resonator are orthogonal to the electric and magnetic fields in the other cavity resonator. The coupling structure of the present invention is oriented between the physically adjacent cavities so that the electric and magnetic fields in one cavity are communicated to the other cavity. The present invention therefore significantly advances the art, for example, with respect to ceramic and metallic resonators, because the electric fields of a ceramic resonator and a metallic combline resonator are orthogonal in a regular structure.

The present invention, by providing significantly improved coupling of these fields, provides benefits including, but not limited to, filters having the features of both ceramic and metallic combline resonators.

Various exemplary embodiments further provide a coupling between a metallic combline resonator and a ceramic resonator in a device that is easier to tune than embodiments that use a loop or a 45 degree aperture cut between the resonators. In fact, various exemplary embodiments eliminate the need for loop tuning altogether.

Various exemplary embodiments further provide a coupling between a metallic combline resonator and a ceramic resonator in a device that is less expensive to manufacture than embodiments that use a loop or a 45 degree aperture cut between the resonators.

Various exemplary embodiments further provide a coupling between a metallic combline resonator and a ceramic resonator in a device that is more stable in operation than embodiments that use a loop or a 45 degree aperture cut between the resonators.

Accordingly, one aspect of various exemplary embodiments includes a ridge between the metallic combline resonator and the ceramic resonator, which converts the electric field of the ceramic resonator into a current carried by the ridge to the metallic combline resonator. Thus, further to this aspect, various exemplary embodiments achieve electrical coupling between a metallic combline resonator and a ceramic resonator.

These and other objects and advantages of the various exemplary embodiments will be apparent from the description herein or can be learned from practicing the various exemplary embodiments, both as embodied herein or as modified in view of any variation which may be apparent to those skilled in the art. Further, the above-summarized objects and advantages of the invention are illustrative of those that can be achieved by the various exemplary embodiments and are not intended to be exhaustive or limiting of the possible advantages which can be realized.

BRIEF DESCRIPTION OF THE DRAWINGS

In order to further understand various exemplary embodiments, reference is made to the accompanying drawings, wherein.

DETAILED DESCRIPTION OF THE PREFERRED EMBODIMENTS OF THE INVENTION

Figure 1:
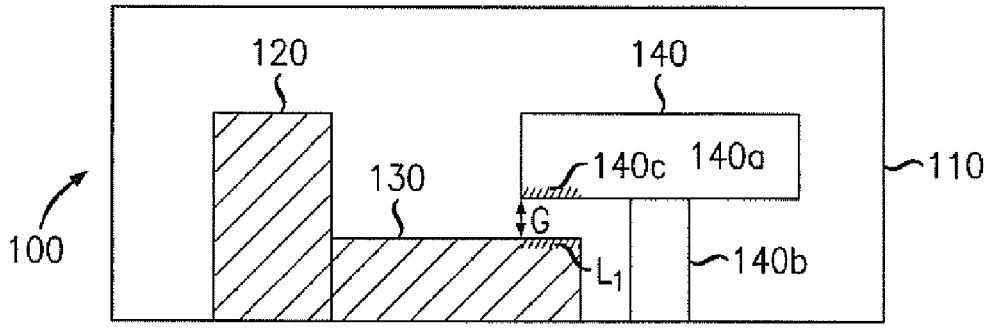
FIG. 1 is a cross-sectional side view of an exemplary embodiment of a coupling between a metallic combline resonator and a ceramic resonator.

Referring now to the drawings, in which like numerals refer to like components or steps, there are disclosed broad aspects of various exemplary embodiments.

FIG. 1 is a cross-sectional side view of an exemplary embodiment of a coupling 100 between a metallic combline resonator 120 and a ceramic resonator 140. Exemplary coupling 100 includes a housing 110 that interacts with metallic post 120 to define a resonator and also interacts with ceramic section 140 to define a resonator. In various exemplary embodiments, the housing 110 is rectangular. As will be apparent to one skilled in the art of resonator design, other shapes may be used for the housing 110.

As described above, at least a portion of the housing 110 contains and interacts with a metallic combline resonator post 120 and a portion of the housing 110 contains and interacts with a ceramic resonator structure 140. For purposes of this description, the term "metallic combline resonator," unless otherwise stated or made clear from the context, means the element 120 and the term "ceramic resonator 140" unless otherwise stated or made clear from the context, means the element 140.

The ceramic resonator 140 has a stem portion 140*b* that extends away from a floor surface of the housing 110 and a puck 140*a*, having a lower surface 140*c*, and that may, for example, be shaped in the form of a mushroom top. The puck 140*a* does not touch any surface of the housing 110. The puck 140*a* of ceramic section 140 interacts with housing 110 to define a resonator while the interaction of stem portion 140*b* with housing 110 is negligible.

In the depicted embodiment, the metallic combline resonator 120 is also disposed upon the floor surface within the housing 110. Ridge 130 extends from the metallic combline resonator 120 underneath the puck 140*a* of the ceramic resonator 140. In the depicted embodiment, the ridge 130 is touching the metallic combline resonator 120. In various exemplary embodiments, the ridge 130 is cast as an integral part of the housing 110. Thus, as depicted, the ridge 130 is touching the floor surface of the housing 110. As shown, the ridge 130 does not touch any portion of the ceramic resonator 140. Thus, there is a particular gap width G that separates the top (not separately labeled) of the ridge 130 from the lower surface 140*c* of the puck 140*a*.

A coupling of energy flows between the metallic combline resonator 120 and the ceramic resonator 140. The orientation of the metallic combline resonator 120 with respect to the orientation of the ceramic resonator 140 within the housing 110 affects the coupling of energy between the metallic combline resonator 120 and the ceramic resonator 140.

For example, the length L1 that the ridge 130 extends underneath the bottom surface 140*c* of the puck 140*a* of the resonator 140 affects the magnitude of the coupling obtained. The magnitude of the coupling can be adjusted by adjusting the height of the ridge 130 which, in turn, changes the distance G. Other issues affecting the coupling that are related to the orientation of the parts will be discussed further below.

Figure 2:
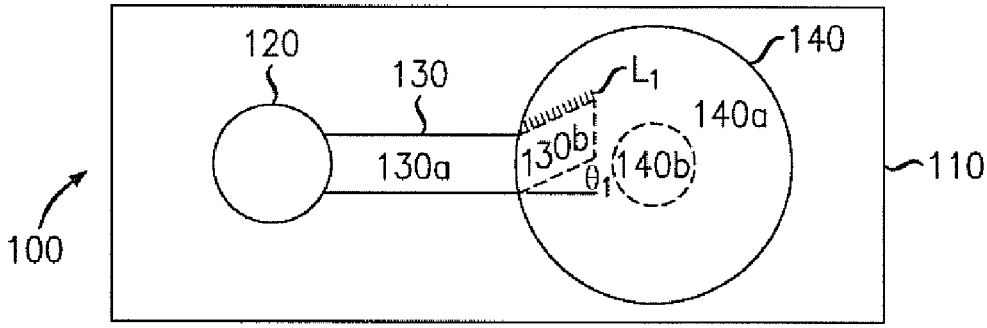
FIG. 2 is a top view of a first exemplary embodiment of a coupling between a metallic combline resonator and a ceramic resonator corresponding to FIG. 1.

FIG. 2 is a top view of a first exemplary embodiment of a coupling 100 between a metallic combline resonator 120 and a ceramic resonator 140 corresponding to FIG. 1. As depicted, the metallic combline resonator 120 has a cylindrical shape and the top portion 140*a* of the ceramic resonator 140 has the shape of a disk.

As is evident from the top view of FIG. 2, in the depicted example a first, or proximal section 130*a* of the ridge 130 extends linearly, in a direction from a center of the metallic combline resonator 120 to a location spaced from the center by a distance approximately equal to the radius of the top portion, i.e., under a perimeter of the ceramic puck 140*a*. Upon reaching this location, a second, or distal section 130*b* of the ridge 130 changes direction and extends linearly underneath the bottom surface 140*c* of the puck 140*a*. As described in reference to FIG. 1, the spacing between the top surface (not separately labeled) of the distal section 130*b* and the bottom surface 140*c* of the puck 140*a* is labeled G. As will be understood by persons skilled in the relevant art, the gap G is preferably small, to provide high coupling, but may be set as desired.

With continuing reference to FIG. 2, the distal section 130*b* of the ridge 130 extends under the bottom surface 140*c* of the ceramic resonator 140 in a direction different than the direction of the proximal section 130*a*. As depicted, the portion of the ridge 130 extending from the metallic combline resonator 120 to the radius of the puck 140*a* of the ceramic resonator 140 has a rectangular shape.

Accordingly, the portion of the ridge 130 underneath the puck 140*a* of the ceramic resonator 140 forms an angle $\Theta_1$ with the portion of the ridge 130 extending from the metallic combline resonator 120 to the radius of the puck 140*a* of the ceramic resonator 140. The magnitude of this angle $\Theta_1$ affects the strength of the field created in the coupling between the metallic combline resonator 120 and the ceramic resonator 140. Thus, in various exemplary embodiments, the magnitude of this angle is varied according to design parameters.

As seen in the top view of FIG. 2, from the perspective of the metallic combline resonator 120 looking towards the ceramic resonator 140, the ridge 130 bends to the left at angle $\Theta_1$ as it passes under the radius of the puck 140*a* of the ceramic resonator 140. This results, for example, in a positively signed field for the coupling between the metallic combline resonator 120 and the ceramic resonator 140 in the exemplary embodiment depicted in FIG. 2.

Figure 3:
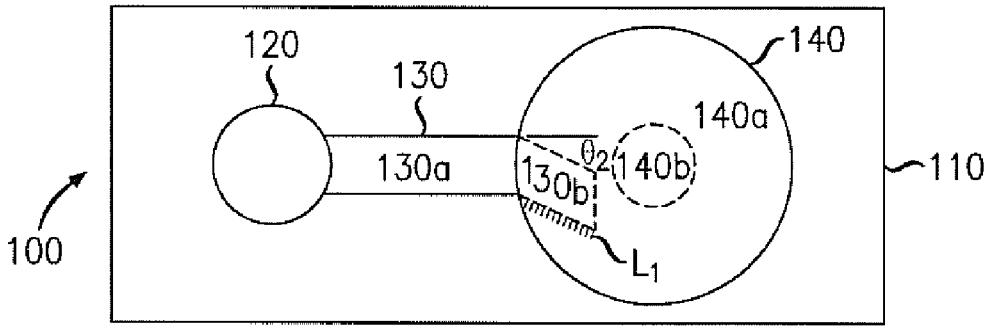
FIG. 3 is a top view of a second exemplary embodiment of a coupling between a metallic combline resonator and a ceramic resonator corresponding to FIG. 1.

FIG. 3 is a top view of a second exemplary embodiment of a coupling 100 between a metallic combline resonator 120 and a ceramic resonator 140 corresponding to FIG. 1. The embodiment depicted in FIG. 3 corresponds to the embodiment depicted in FIG. 2, except that, as seen in this top view, from the perspective of the metallic combline resonator 120 looking towards the ceramic resonator 140, the ridge 130 bends to the right at angle $\Theta_2$, where $\Theta_2$ may be the opposite of $\Theta_1$, as it passes under the radius of the puck 140*a* of the ceramic resonator 140.

This difference results in the sign of the coupling being reversed in FIG. 3 as compared to the sign of the coupling for the embodiment depicted in FIG. 2. This results, for example, in a negatively signed field for the coupling between the metallic combline resonator 120 and the ceramic resonator 140 in the exemplary embodiment depicted in FIG. 3.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. An apparatus having coupled combline and ceramic resonators, comprising:

a housing comprising a floor surface and a wall surface;

a combline resonator comprising at least a portion of said floor surface, at least a portion of said wall surface, and a metallic post attached to said floor surface;

a ceramic resonator comprising at least a portion of said floor surface, at least a portion of said wall surface, and separated from said combline resonator by a space, said ceramic resonator further comprising a stem portion that extends away from said floor surface of said housing and a ceramic puck, having an upper surface and a lower surface, that does not touch any surface of said housing;

a coupler comprising a metallic ridge on said floor surface within said housing, said ridge extending away from said metallic post toward said stem portion, and a distal portion extending under said lower surface of said puck, wherein said ridge is formed as an integral part of said housing.

2. The apparatus of claim 1, wherein said housing has a rectangular cross-section.

3. The apparatus of claim 1, wherein a coupling is obtained between an electric field of said metallic post and an electrical field of said puck.

4. The apparatus of claim 3, wherein said coupling between said metallic post and said puck consists essentially of an electric field between said ridge and said puck.

5. The apparatus of claim 1, wherein said ridge extends linearly away from said metallic post such that a portion of said ridge from said metallic post to a radius of said puck has a rectangular cross-section.

6. The apparatus of claim 1, wherein said metallic post is cylindrical in shape.

7. The apparatus of claim 1, wherein said puck has a circular cross-section.

8. An apparatus having coupled combline and ceramic resonators, comprising:

a housing comprising a floor surface and a wall surface;

a combline resonator comprising at least a portion of said floor surface, at least a portion of said wall surface, and a metallic post attached to said floor surface;

a ceramic resonator comprising at least a portion of said floor surface, at least a portion of said wall surface, and separated from said combline resonator by a space, said ceramic resonator further comprising a stem portion that extends away from said floor surface of said housing and a ceramic puck, having an upper surface and a lower surface, that does not touch any surface of said housing; and a coupler comprising a metallic ridge on said floor surface within said housing, wherein at least a portion of the ridge is angled relative to a horizontal axis along the lower surface of the ceramic puck and a sign of an electric field of a coupling between said metallic post and said puck is negative.

9. The apparatus of claim 8, wherein the metallic ridge further comprises:

a first section and a second section.

10. The apparatus of claim 9, wherein the first section is angled relative to the second section.

11. The apparatus of claim 9, wherein the first section is parallel to the horizontal axis along the lower surface of the ceramic puck.

12. An apparatus having coupled combline and ceramic resonators, comprising;

a housing comprising a floor surface and a wall surface;

a combline resonator comprising at least a portion of said floor surface, at least a portion of said wall surface, and a metallic post attached to said floor surface;

a ceramic resonator comprising at least a portion of said floor surface, at least a portion of said wall surface, and separated from said combline resonator by a space, said ceramic resonator further comprising a stem portion that extends away from said floor surface of said housing and a ceramic puck; having an upper surface and a lower surface, that does not touch any surface of said housing; and a coupler comprising a metallic ridge on said floor surface within said housing, wherein at least a portion of the ridge is angled relative to a horizontal axis along the lower surface of the ceramic puck and a sign of an electric field of a coupling between said metallic post and the said puck is positive.

13. The apparatus of claim 12, wherein the metallic ridge further comprises:

a first section and a second section.

14. The apparatus of claim 13, wherein the first section is angled relative to the second section.

15. The apparatus of claim 13, wherein the first section is parallel to the horizontal axis along the lower surface of the ceramic puck.

* * * * *

UNITED STATES PATENT AND TRADEMARK OFFICE

CERTIFICATE OF CORRECTION

PATENT NO. : 7,956,707 B2
APPLICATION NO. : 12/255413
DATED : June 7, 2011
INVENTOR(S) : Bill Engst It is certified that error appears in the above-identified patent and that said Letters Patent is hereby corrected as shown below:

Column 5, line 34, claim 1, please insert after "puck" --disposed on the stem--; insert before "having" --said ceramic puck--.

Column 6, line 12, claim 8, please insert after "puck" --disposed on the stem--; insert before "having" --said ceramic puck--.

Column 6, line 40, claim 12, please insert after "puck" --disposed on the stem--; insert before "having" --said ceramic puck--.

Signed and Sealed this
Sixteenth Day of August, 2011

David J. Kappos

David J. Kappos
*Director of the United States Patent and Trademark Office*